US005239805A

United States Patent [19]

Uchida et al.

[11] Patent Number: 5,239,805

[45] Date of Patent: Aug. 31, 1993

[54] METHOD OF PACKING A DEVELOPER CARTRIDGE

[75] Inventors: Katsuzo Uchida, Ikoma; Keiji Kato; Yukinori Andou, both of Nara; Naoyuki Yamane, Yamatokoriyama; Yasuo Imai, Nara, all of Japan

[73] Assignee: Sharp Kabushiki Kaisha, Osaka, Japan

[21] Appl. No.: 935,819

[22] Filed: Aug. 26, 1992

[30] Foreign Application Priority Data

Aug. 29, 1991 [JP] Japan ..... 3-218684

[51] Int. Cl.[5] ..... B65B 61/18; B65B 5/04; B65B 7/06; B65B 7/28

[52] U.S. Cl. ..... 53/412; 53/415; 53/449; 53/469; 53/492

[58] Field of Search ..... 53/412, 415, 449, 428, 53/459, 469, 468, 479, 133.3, 135.2, 136.4, 492

[56] References Cited

U.S. PATENT DOCUMENTS 2,923,110 2/1960 Tamarin ..... 53/412
3,795,080 3/1974 Smolderen et al. ..... 53/412
4,065,335 12/1977 Pollack ..... 53/412
4,656,042 4/1987 Risler ..... 53/449 X
5,125,211 6/1992 O'Brien et al. ..... 53/412

FOREIGN PATENT DOCUMENTS 62-229170 10/1987 Japan .

*Primary Examiner*—Horace M. Culver
*Attorney, Agent, or Firm*—David G. Conlin; George W. Neuner

[57] ABSTRACT

The object of the present invention is to provide a method of packaging a developer cartridge especially for use in the image-forming of the electrophotographic process, the method by which the operativity of users can be improved and the pollution due to the sealing member of the developer cartridge can be prevented. The object of the present invention is achieved by fixing a free end of the above sealing member held between the sealing portions of the packing bag when the packing bag is hermetically sealed. With this, the sealing member is pulled off in accordance with the developer cartridge being drawn out from the bag when it is used. When the whole part of the developer cartridge is drawn out, the sealing member is completely pulled off, and is left inside the packing bag.

2 Claims, 2 Drawing Sheets

METHOD OF PACKING A DEVELOPER CARTRIDGE

BACKGROUND OF THE INVENTION

Field of the Invention

The present invention relates to a method of packing a developer cartridge sealingly holding a developer in a packing bag when it is shipped, and more particularly to a preferable method of packing a cartridge of developer for use in an electrophotographic process.

Description of the Related Art

In a developer cartridge hermetically filled with a developer for use in the image-forming, especially, for electrophotographic process, an opening portion thereof is confined by attaching a plastic cover and padding a foam member etc., and sealed over the top of the cartridge by applying an adhesive tape, heat-sealing a sealing member, or other way.

Upon shipment of such developer cartridges, in order to prevent the developer cartridge from being damaged and damped, the developer cartridge 1 is, as shown in FIG. 1, inserted into a packing bag 2 made of polyethylene or aluminum-deposited polyethylene from an opening 2*a* located on one end of the packing bag 2. Then the packing bag 2 is hermetically closed by heat-sealing a sealing portion 3.

One of such a package is disclosed in Japanese Patent Laid-Open Publication No.sho-62-229170, which is equivalent to U.S. Pat No. 4,742,370 in which a packing bag 2 is constructed with a nylon layer, a polyethylene layer, aluminum foil and polyethylene layer in this order from the outside, so that moisture proof of developer for use in image forming apparatuses of electrophotographic process may be maintained.

On the other hand, the packing bag 2 normally has a recessed notch 4 for tear-opening formed on the opposite side of the opening 2*a*. From this recessed notch, a user rends up the packing bag 2 to be opened and takes out the developer cartridge 1.

In the figure, reference numerals 1*a* and 5 denote an opening portion and a sealing member respectively.

The conventional packing is effected as stated above. That is, handling a developer cartridge 1 requires a user to effect two steps, first of which is to take out the developer cartridge 1 from the packing bag 2, and the second is to strip the sealing member 5 from the developer cartridge 1. In addition to these, it is necessary to dump the packing bag 2, and still more to throw away the sealing member 5, thus requiring troublesome labour.

Moreover, in some cases the sealing member 5 bearing the developer thereon may accidentally come into contact with and dirty the user's clothes, etc. when the sealing member 5 is pulled off.

SUMMARY OF THE INVENTION

The present invention has been achieved in view of what is discussed above, and it is therefore an object of the present invention to provide a method of packaging a developer cartridge, the method by which the operativity of users can be improved and the pollution due to the sealing member of the developer cartridge can be prevented.

The present invention is achieved by a method of packing a developer cartridge, wherein a developer cartridge holding a developer is inserted into a packing bag from an opening end thereof, thereafter the opening of the packing bag is sealed and the other end of the packing bag is torn open to take out the developer cartridge when it is used, comprising the steps of: sealing an opening portion of the developer cartridge holding a developer, with a sealing member having a folded flap portion longer than the length of said opening portion; inserting the developer cartridge into an packing bag from the opening thereof such that the free end of the folded flap portion is made to locate in the opening edge of the packing bag; and sealing the opening portion together with the free end of the flap portion held between the both sides of the opening edge, so that when the developer cartridge is drawn out for use, the sealing member is left inside the packing bag.

In this connection, it is effective to form the packing bag such that the length of the packing bag is longer than the length of the folded flap portion of the sealing member of the developer cartridge.

In the above-described means to solving the problems, with the developer cartridge being taken out from the packing bag, the sealing member is pulled off from the developer cartridge, since the sealing member is fixed at its one end to the packing bag. When the whole part of the developer cartridge is drawn out, the sealing member is completely pulled off, being left inside the packing bag.

Thus, only the step of drawing out the developer cartridge from the packing bag, makes it possible to effect the step of stripping the sealing member from the developer cartridge at the same time.

DESCRIPTION OF THE PREFERRED EMBODIMENTS

An embodiment of the present invention will be described hereinafter with reference to the accompanying drawings.

Figure 1:
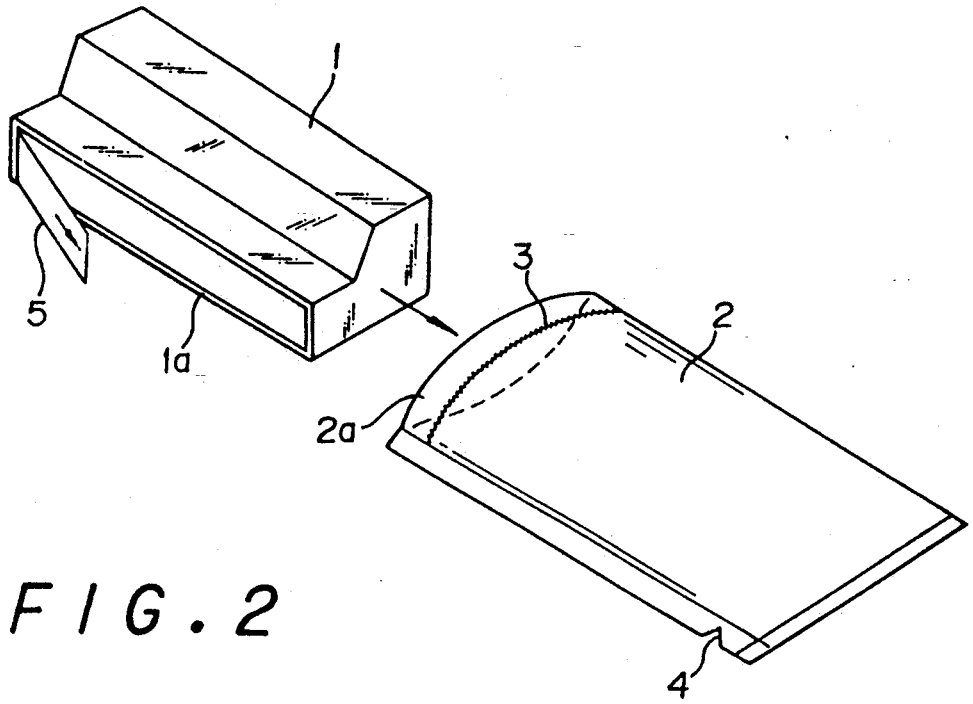
FIG. 1 is a perspective view showing a state when a conventional developer cartridge is inserted into a packing bag.
Figure 2:
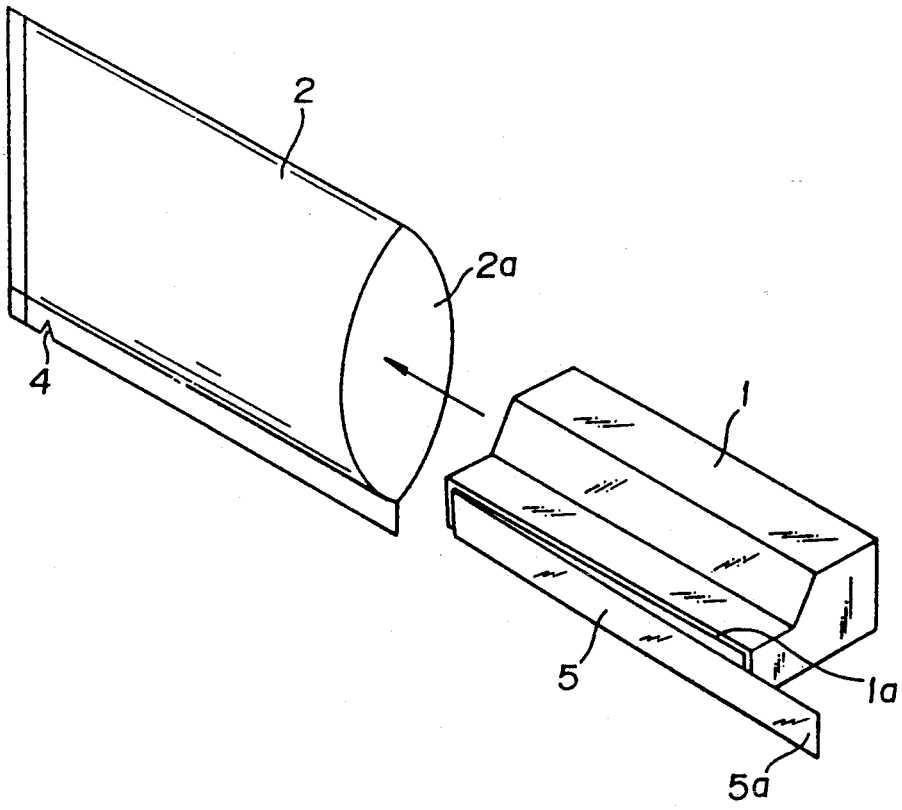
FIG. 2 is a perspective view showing a state when a developer cartridge is inserted into a packing bag of an embodiment according to the present invention.
Figure 3:
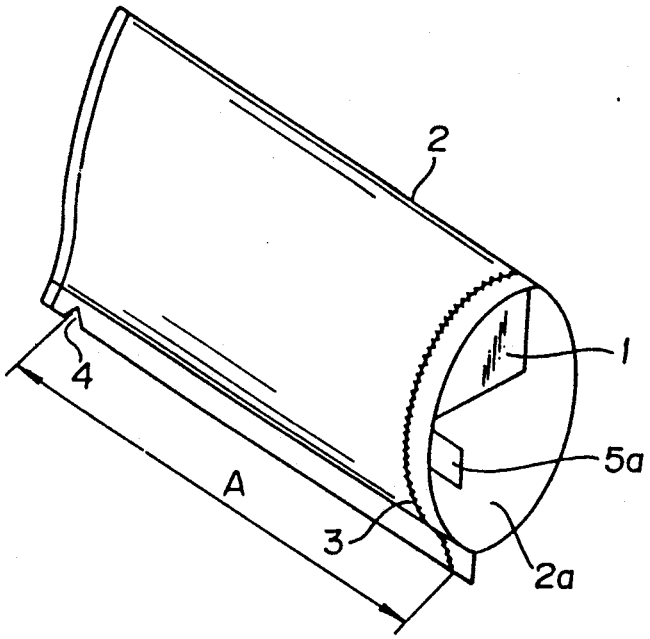
FIG. 3 is a perspective view showing a state when the packing bag is sealed.
Figure 4:
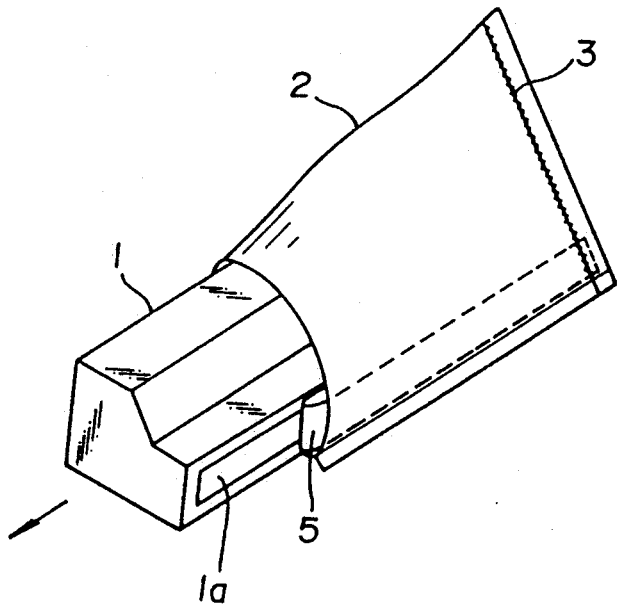
FIG. 4 is a perspective view showing a state when the developer cartridge is taken out from the packing bag.

FIG. 2 is a perspective view showing a state when a developer cartridge is inserted into a packing bag of an embodiment according to the present invention; FIG. 3 is a perspective view showing a state when the packing bag is sealed; and FIG. 4 is a perspective view showing a state when the developer cartridge is taken out from the packing bag.

As shown in FIG. 2, a developer cartridge 1 of this embodiment has a sealing member 5 thermally compression-bonded on the opening portion 1*a* thereof in order to hermetically hold a developer. The sealing member 5 comprises a sealing portion for sealing the opening portion la and a folded flap portion which extends such that the free end 5*a* of the folded flap portion projects out over the side of the developer cartridge 1. The developer cartridge 1 further comprises a roller or other structure arranged around the opening portion l*a* for preventing the developer from scattering from the opening portion 1*a* when the sealing member 5 is stripped.

In order to hermetically store the developer cartridge 1, there is provided a packing bag 2, which is made of a polyethylene film with aluminum deposited thereon and has an opening 2*a* on one side thereof. The packing bag 2 has a recessed notch 4 for tear-opening formed at the opposite side, and is adapted to be torn open on the side using the notch.

Next will be made an explanation of a method for packing the above developer cartridge 1 with the packing bag 2.

At first, the developer cartridge 1 is inserted into the opening 2*a* of the packing bag 2 such that the free end 5*a* of the sealing member 5 is located at the opening side.

Upon the completion of the insertion, while the free end 5*a* of the sealing member 5 is held between the both sides of the edges of the opening 2*a* of the packing bag 2, the packing bag 2 is thermally sealed in a sealing portion 3, as shown in FIG. 3. With this operation, the opening 2*a* of the packing bag 2 is hermetically closed, and at the same time the free end 5*a* of the sealing member 5 is fixed to the packing bag 2.

The developer cartridge 1 thus packed is shipped. Upon using the developer cartridge 1, a user tears the packing bag 2 open from the recessed notch 4 of the packing bag 2. Then, the user draws out the developer cartridge 1 from the packing bag 2, as shown in FIG. 4. In the course of the drawing, the sealing member 5 is stripped from the developer cartridge 1 to expose the opening portion 1*a*, since the free end of the sealing member 5 is fixed to the packing bag 2.

When the developer cartridge 1 is wholly drawn out from the packing bag 2, the sealing member 5 is completely taken off. Here, if the length of the folded flap portion of the sealing member 5 is set to be shorter than the size A of the packing bag 2 as shown in FIG. 3, the drawn-off sealing member 5 is wholly kept inside the packing bag 2. Accordingly, the sealing member 5 bearing the developer does not get out of the packing bag 2, so that the sealing member 5 would not come into contact with the user's clothes and other portions, resulting in prevention against pollution.

It should be noted that the way of sealing the packing bag 2 is not limited to the heat-sealing, but the packing bag 2 may be stitched with thread or stapled.

As is described above, only a step of drawing out the developer cartridge 1 from the packing bag 2, makes it possible to effect at the same time the step of stripping the sealing member 5 from the developer cartridge 1. This results in a reduction of the operation steps in number and makes the operation easier. Furthermore, the sealing member 5 can be dumped together with the packing bag 2, thereby causing the waste not to be bulky.

It should be understood that the present invention is not limited to the specific embodiments described above, and many modifications and changes can be made to the above embodiment within the scope of the present invention.

As is apparent from the description above, in accordance with the present invention, the developer cartridge has an opening sealed by a sealing member having a free end in order to confine a developer held therein. The developer cartridge is stored into a packing bag from an opening at one end thereof. Thereafter when the opening of the packing bag is hermetically sealed, the free end of the sealing member of the developer cartridge is fixed being held between the sealing portion of the packing bag. Therefore, when the developer cartridge is drawn out from the bag, the sealing member is left inside the packing bag. As a result, only the step of drawing out the developer cartridge from the packing bag, makes it possible to effect the step of stripping the sealing member from the developer cartridge at the same time.

Accordingly, the number of the steps for taking out of the developer cartridge can be reduced compared to prior art and the operation is made easy. Furthermore, the sealing member can be dumped together with the packing bag, thereby resulting in a reduction of waste in size.

Moreover, the packing bag is designed to be longer than the length of the folded flap portion of the sealing member of the developer cartridge, and the peeled sealing member wholly remains inside the packing bag, so that the dirtied sealing member with the developer does not come out. As a result, the dirtied sealing member is prevented from coming in contact with, and polluting user's clothes etc.

What is claimed is:

1. A method of packing a developer cartridge, wherein a developer cartridge holding a developer is inserted into a packing bag from an open end thereof, thereafter the open end of the packing bag is sealed and the packing bag is torn open to take out the developer cartridge when it is used, the method comprising the steps of:

sealing an opening portion of the developer cartridge holding a developer, with a sealing member having a folded flap portion longer than the length of said opening portion;

inserting the developer cartridge into a packing bag from the open end thereof such that a free end of the folded flap portion is made to locate in the open end at an edge of the packing bag; and sealing the open end of the packing bag together with the free end of the flap portion so that, when the developer cartridge is drawn out for use, the sealing member is left inside the packing bag.

2. A method of packaging a developer cartridge, according to claim 1, wherein, the length of the packing bag is greater than the length of the folded flap portion of the sealing member of the developer cartridge.

* * * * *